US011017699B2

(12) United States Patent
Kim et al.

(10) Patent No.: US 11,017,699 B2
(45) Date of Patent: May 25, 2021

(54) DISPLAY PANEL AND DISPLAY DEVICE INCLUDING LIGHTING TEST CIRCUIT

(71) Applicant: Samsung Display Co., Ltd., Yongin-Si (KR)

(72) Inventors: Hyunwoong Kim, Gwangmyeong-si (KR); Seung-Kyu Lee, Asan-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/256,963

(22) Filed: Jan. 24, 2019

(65) Prior Publication Data

US 2019/0311662 A1 Oct. 10, 2019

(30) Foreign Application Priority Data

Apr. 9, 2018 (KR) ..... 10-2018-0041060

(51) Int. Cl.
*G09G 3/00* (2006.01)
*G09G 3/20* (2006.01)

(52) U.S. Cl.
CPC ..... *G09G 3/006* (2013.01); *G09G 3/2003* (2013.01); *G09G 2310/0297* (2013.01)

(58) Field of Classification Search
CPC ..... G09G 3/006; G09G 3/2003; G09G 2310/0297
See application file for complete search history.

(56) References Cited

U.S. PATENT DOCUMENTS

2007/0109245 A1* 5/2007 Hwang ..... G09G 3/006 345/98
2008/0054798 A1* 3/2008 Jeong ..... G09G 3/3233 313/504
2009/0146678 A1* 6/2009 Chen ..... G09G 3/006 324/760.02
2011/0080173 A1* 4/2011 Kim ..... G09G 3/006 324/403
2014/0240521 A1* 8/2014 Kwak ..... H04N 17/004 348/189
2014/0354285 A1* 12/2014 Kim ..... G09G 3/3233 324/414
2015/0090961 A1* 4/2015 Lee ..... H01L 22/30 257/40

FOREIGN PATENT DOCUMENTS

KR 10-0712179 B1 4/2007

* cited by examiner

*Primary Examiner* — Stephen G Sherman
(74) *Attorney, Agent, or Firm* — Innovation Counsel LLP

(57) ABSTRACT

A display panel may include a plurality of pixel groups, a first lighting test circuit for testing at least one pixel of the plurality of pixel groups, a demultiplexer for providing data signals to the plurality of pixel groups, and a second lighting test circuit for testing one or more pixels of the plurality of pixel groups. At least one of the first lighting test circuit and the demultiplexer is positioned between the plurality of pixel groups and the second lighting test circuit.

20 Claims, 11 Drawing Sheets

DISPLAY PANEL AND DISPLAY DEVICE INCLUDING LIGHTING TEST CIRCUIT

CROSS-REFERENCE TO RELATED APPLICATION(S)

This application claims priority under 35 USC § 119 to Korean Patent Application No. 10-2018-0041060, filed on Apr. 9, 2018 in the Korean Intellectual Property Office (KIPO); the contents of the Korean Patent Application are incorporated herein in its entirety by reference.

BACKGROUND

1. Technical Field

The technical field is related to a display panel and a display device.

2. Description of the Related Art

Examples of display devices include liquid crystal display (LCD) devices, field emission display (FED) devices, plasma display panel (PDP) devices, and organic light emitting display (OLED) devices. A display device may include a display panel.

In the manufacturing process of a display device, defects of the display panel of the display device may be detected through one or more lighting tests. A lighting test circuit for performing a lighting test of the display panel may be formed in a non-display area of the display panel.

SUMMARY

Some example embodiments are related a display panel having a minimum non-display area.

Some example embodiments are related to a display device having a minimum non-display area.

According to example embodiments, a display panel may include a display area including a plurality of data lines that extends in a first direction and are arranged in a second direction perpendicular to the first direction and a plurality of pixel rows coupled to the data lines, a non-display area configured to surround the display area, a first lighting test circuit formed in the non-display area adjacent to the display area in the first direction, the first lighting test circuit configured to provide a lighting test voltage to the pixel rows through the data line, a demultiplexer formed in the non-display area adjacent to the first lighting test circuit in the first direction, the demultiplexer configured to provide a data signal to the pixel rows through the data line, and a second lighting test circuit formed in the non-display area adjacent to the demultiplexer in the first direction, the second lighting test circuit configured to provide the lighting test voltage to the pixel rows through the data line.

In example embodiments, the non-display area may include a mounting area of a data integrated circuit (IC) on which the data integrated circuit that provides the data signal is mounted.

In example embodiments, the second lighting test circuit may be formed in the mounting area of the data integrated circuit.

In example embodiments, the second lighting test circuit may be formed in a cutting area adjacent to the mounting area of the data integrated circuit in the first direction.

In example embodiments, the second lighting test circuit may be cut after a lighting test process.

In example embodiments, the display area may a first pixel row including a first pixel that displays a first color and a second pixel that displays a second color that are alternately arranged, a second pixel row including a third pixel that displays a third color, and a third pixel row including the first pixel and the second pixel arranged in an inverse order to the first pixels row.

In example embodiments, the first lighting test circuit may provide the lighting test voltage to the second pixel row, and the second lighting test circuit may provide the lighting test voltage to the first pixel row and the third pixel row.

In example embodiments, the second lighting test circuit may alternately provide the lighting test voltage to the first pixel and the second pixel included in the first pixel row and the third pixel row.

In example embodiments, the first lighting test circuit may include a third transistor that provides a third lighting test voltage to the third pixel in response to a third test control signal.

In example embodiments, the second lighting test circuit may include a first transistor configured to provide a first lighting test voltage to the first pixel in response to a first test control signal and a second transistor configured to provide a second lighting test voltage to the second pixel in response to a second test control signal.

In example embodiments, the first lighting test circuit may provide the lighting test voltage to the first pixel row and the third pixel row, and the second lighting test circuit may provide the lighting test voltage to the second pixel row.

In example embodiments, the first lighting test circuit may alternately provide the lighting test voltage to the first pixel and the second pixel included in the first pixel row and the third pixel row.

In example embodiments, the first lighting test circuit may include a first transistor configured to provide a first lighting test voltage to the first pixel in response to a first test control signal and a second transistor configured to provide a second lighting test voltage to the second pixel in response to a second test control signal.

In example embodiments, the second lighting test circuit may include a third transistor configured to provide a third lighting test voltage to the third pixel in response to a third test control signal.

According to example embodiments, a display device may include a display panel including a display area that includes a plurality of pixel row and a non-display area that surrounds the display area, the display panel including a first lighting test circuit formed adjacent to a side of the display area, a demultiplexer formed adjacent to a side of the first lighting test circuit, and a second lighting test circuit formed adjacent to a side of the demultiplexer, a data driver configured to generate a data signal, wherein the data driver is implemented as a data integrated circuit (IC) and is mounted in a mounting area of the data integrated circuit of the non-display area, a scan driver configured to generate a scan signal provided to the pixel row, and a timing controller configured to generate a control signal that controls the data driver and the scan driver.

In example embodiments, the second lighting test circuit may be formed in the mounting area of the data integrated circuit.

In example embodiments, the second lighting test circuit may be formed in a cutting area adjacent to a side of the mounting area of the data integrated circuit, and the cutting area may be cut after a lighting test process.

In example embodiments, the display area may include a first pixel row including a first pixel that displays a first color and a second pixel that displays a second color that are alternatively arranged, a second pixel row including a third pixel that displays a third color, and a third pixel row including the first pixel and the second pixel arranged in an inverse order to the first pixel row.

In example embodiments, the first lighting test circuit may provide the lighting test voltage to the first pixel row and the third pixel row, and the second lighting test circuit may provide the lighting test voltage to the second pixels row.

In example embodiments, the first lighting test circuit may provide the lighting test voltage to the second pixel row, and the second lighting test circuit may provide the lighting test voltage to the first pixel row and the third pixel row.

Embodiments may be related to a display panel. The display panel may include the following elements: a first data line and a second data line each extending in a first direction; a first pixel group electrically connected to the first data line; a second pixel group electrically connected to the second data line; a first lighting test circuit configured to provide a first lighting test voltage to at least one of a pixel of the first pixel group and a pixel of the second pixel group through at least one of the first data line and the second data line; a demultiplexer configured to provide data signals to the first pixel group and the second pixel group through the first data line and the second data line, respectively; and a second lighting test circuit configured to provide a second lighting test voltage to one or more of the pixel of the first pixel group and the pixel of the second pixel group through one or more of the first data line and the second data line. At least one of the first lighting test circuit and the demultiplexer may be positioned between the second lighting test circuit and the first pixel group in the first direction.

The display panel may include a data integrated circuit configured to provide the data signals to the demultiplexer.

The second lighting test circuit may overlap the data integrated circuit.

The data integrated circuit may be positioned between the second lighting test circuit and the demultiplexer in the first direction.

The display panel may include the following elements: a third data line extending in the second direction; and a third pixel group electrically connected to the third data line. The first pixel group may include a first first-color pixel that displays a first color and a first second-color pixel that displays a second color. The second pixel group may include a third-color pixel that displays a third color. The third pixel group may include a second first-color pixel that displays the first color and a second second-color pixel that displays the second color. The first first-color pixel may be aligned with the second second-color pixel in a second direction different from the first direction. The first second-color pixel may be aligned with the second first-color pixel in the second direction.

The first lighting test circuit may provide the first lighting test voltage to the second pixel group. The second lighting test circuit may provide the second lighting test voltage to the first pixel group and the third pixel group.

The second lighting test circuit may alternately provide the second lighting test voltage to the first first-color pixel and the first second-color pixel.

The first lighting test circuit may include a transistor configured to provide a third lighting test voltage to the third-color pixel in response to a test control signal.

The second lighting test circuit may include the following elements: a first transistor configured to provide a first test voltage to the first first-color pixel in response to a first control signal; and a second transistor configured to provide a second test voltage to the first second-color pixel in response to a second control signal.

The first lighting test circuit may provide the first lighting test voltage to the first pixel group and the third pixel group. The second lighting test circuit may provide the second lighting test voltage to the second pixel group.

The first lighting test circuit may alternately provide the first lighting test voltage to the first first-color pixel and the first second-color pixel.

The first lighting test circuit may include the following elements: a first transistor configured to provide a first test voltage to the first first-color pixel in response to a first control signal; and a second transistor configured to provide a second test voltage to the first second-color pixel in response to a second control signal.

The second lighting test circuit may include a transistor configured to provide a third lighting test voltage to the third-color pixel in response to a test control signal.

Embodiments may be related to method for manufacturing a display panel. The method may include the following steps: providing a first data line and a second data line electrically insulated from each other; providing a first pixel group electrically connected to the first data line; providing a second pixel group electrically connected to the second data line; providing a first lighting test circuit configured to provide a first lighting test voltage to at least one of a pixel of the first pixel group and a pixel of the second pixel group through at least one of the first data line and the second data line; providing a demultiplexer configured to provide data signals to the first pixel group and the second pixel group through the first data line and the second data line, respectively; providing a second lighting test circuit configured to provide a second lighting test voltage to one or more of the pixel of the first pixel group and the pixel of the second pixel group through one or more of the first data line and the second data line. At least one of the first lighting test circuit and the demultiplexer may be positioned between the second lighting test circuit and the first pixel group; performing a lighting test process using at least the second lighting test circuit; and after the lighting test process, removing the second lighting test circuit such that the display panel does not include the second lighting test circuit.

Embodiments may be related to a display device. The display device may include the following elements: a plurality of pixel groups; a first lighting test circuit for testing at least one pixel of the plurality of pixel groups; a demultiplexer for providing data signals to the plurality of pixel groups; a second lighting test circuit for testing one or more pixels of the plurality of pixel groups, wherein at least one of the first lighting test circuit and the demultiplexer may be positioned between the plurality of pixel groups and the second lighting test circuit; a data integrated circuit configured to generate the data signals; a scan driver configured to generate scan signals for controlling supply of the data signals to the plurality of pixel groups; and a timing controller configured to generate control signals that control the data integrated circuit and the scan driver.

The second lighting test circuit may overlap the data integrated circuit.

The display device may include a display panel substrate. The second lighting test circuit may be positioned between the display panel substrate and the data integrated circuit.

The plurality of pixel groups may include the following pixel groups: a first pixel group including a first first-color pixel that displays a first color and a first second-color pixel that displays a second color; a second pixel group including a third-color pixel that displays a third color; and a third pixel group including a second first-color pixel and a second second-color pixel. The first first-color pixel may be aligned with the second second-color pixel in a direction. The first second-color pixel may be aligned with the second first-color pixel in the direction.

The first lighting test circuit may provide a first lighting test voltage to the first pixel group and the third pixel group. The second lighting test circuit may provide a second lighting test voltage to the second pixels group.

The first lighting test circuit may provide a first lighting test voltage to the second pixel group. The second lighting test circuit may provide a second lighting test voltage to the first pixel group and the third pixel group.

According to embodiments, a display panel and/or display device may have a small size and a light weight.

DETAILED DESCRIPTION OF EMBODIMENTS

Example embodiments are described with reference to the accompanying drawings. Although the terms "first," "second," etc. may be used herein to describe various elements, these elements, should not be limited by these terms. These terms may be used to distinguish one element from another element. Thus, a first element may be termed a second element without departing from teachings of one or more embodiments. The description of an element as a "first" element may not require or imply the presence of a second element or other elements. The terms "first," "second," etc. may also be used herein to differentiate different categories or sets of elements. For conciseness, the terms "first," "second," etc. may represent "first-type (or first-set)," "second-type (or second-set)," etc., respectively. The term "coupled" may mean "electrically connected"; the term "connected" may mean "electrically connected"; the term "row" may mean "row," "column," "line," or "group"; the term "data voltage" may be used interchangeably with the term "data signal."

Figure 1A:
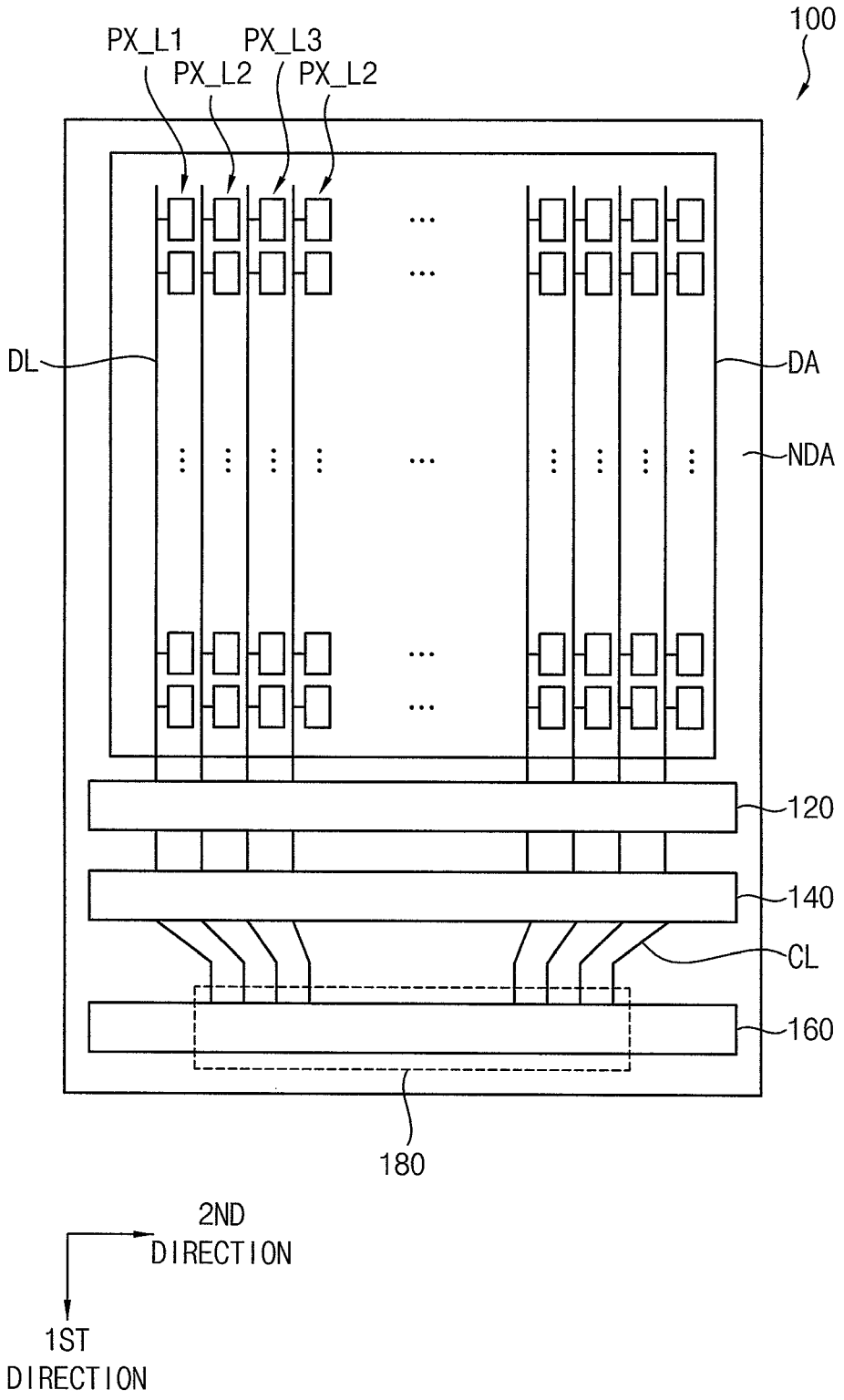
FIG. 1A is a diagram (e.g., a plan view) illustrating a display panel according to example embodiments.
Figure 1B:
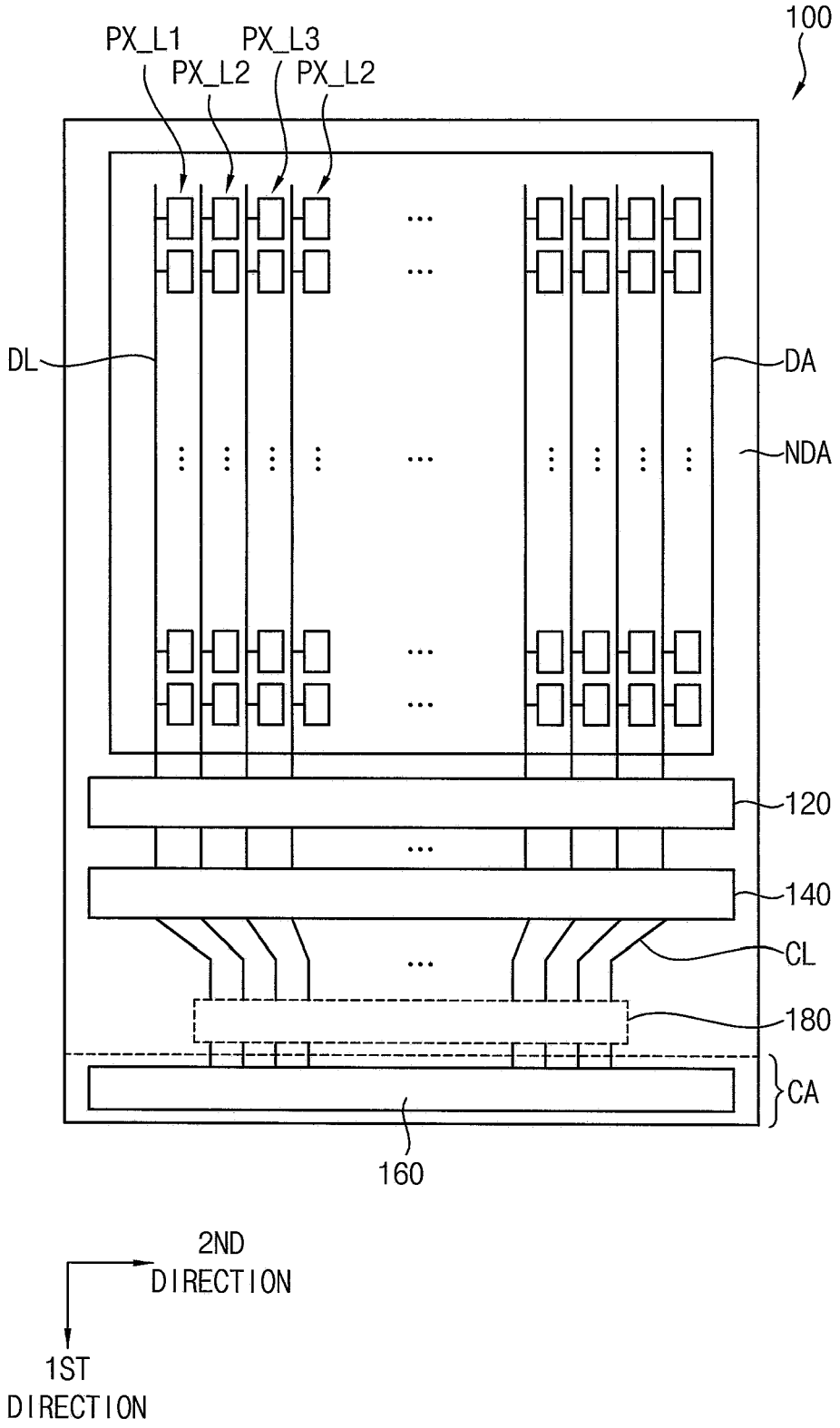
FIG. 1B is a diagram (e.g., a plan view) illustrating a display panel according to example embodiments.

FIGS. 1A and 1B are diagrams illustrating display panels according to example embodiments.

Referring to FIGS. 1A and 1B, a display panel 100 may include a display area DA and a non-display area NDA.

In the display area DA, data lines DL extend in a first direction 1ST DIRECTION and are arranged in a second direction 2ND DIRECTION perpendicular to the first direction 1ST DIRECTION. The first direction 1ST DIRECTION may be perpendicular to an upper side of the display panel 100 and the second direction 2ND DIRECTION may be parallel to the upper side of the display panel. Each of the data lines may be electrically coupled to a pixel row.

Each of the pixel rows may be arranged in parallel to the data lines DL. Pixels included in each of the pixel row may emit light in response to a lighting test voltage provided through a data line DL in a lighting test process. In some example embodiments, the display area DA may include a first pixel row PX_L1, a second pixel row PX_L2, and a third pixel row PX_L3. The first pixel row PX_L1 may include first-color pixels (or first pixels) that display a first color and second-color pixels (or second pixels) that display a second color. The first pixels and the second pixels in the first pixel row PX_L1 may be alternately arranged. The second pixel row PX_L2 may include third-color pixels (or third pixels) that display a third color. The third pixel row PX_L3 may include first pixels and second pixels. The first pixels and second pixels included in the third pixel row PX_L3 may be arranged in an inverse order with respect to the first pixels and second pixels included in the first pixel row PX_L1. For example, the first color may be a red, the second color may be a blue, and the third color may be a green. For example, the display area DA may have a layout in which sets including a first pixel row PX_L1, a second pixel row PX_L2, a third pixel row PX_L3, and another second pixel row PX_L2 are repeatedly arranged in a second direction 2ND DIRECTION as illustrated in FIGS. 1A and 1B.

The display area DA may further include scan lines that extend in the second direction 2ND DIRECTION and are arranged in the first direction 1ST DIRECTION although the scan lines are not shown in FIGS. 1A and 1B. Each of the pixels included in the pixels row may be arranged in an intersection region of a data line DL and a scan line. Each of the pixels may emit light having a luminance corresponding to a data signal provided through the corresponding data line DL in response to a scan signal provided through the corresponding scan line when the display panel 100 is driven. Scan signals may control supply of data signals to the pixels.

The non-display area NDA may abut and/or surround the display area DA. A first lighting test circuit 120, a demultiplexer 140, and a second lighting test circuit 160 may be formed in the non-display area NDA.

The first lighting test circuit 120 may be formed in the non-display area NDA adjacent to the display area DA in the first direction 1ST DIRECTION. The first lighting test circuit 120 may provide a lighting test voltage to the pixel row in the display area DA through the data line DL in the lighting test process of the display panel 100. In some example embodiments, the first lighting test circuit 120 may provide the lighting test voltage to the second pixel row PX_L2. The first lighting test circuit 120 may provide the lighting test voltage to a third pixel included in the second pixel row PX_L2 and may detect a lighting defect of the third pixel. The first lighting test circuit 120 may include a third transistor that provides a third lighting test voltage to the third pixel in response to a third test control signal. In the lighting test process of the display panel 100, the third transistor may turn on in response to the third test control signal and provide the third lighting test voltage to the third pixel. In example embodiments, the first lighting test circuit 120 may provide a lighting test voltage to a first pixel row PX_L1 and the third pixel row PX_L3. The first lighting test circuit 120 may provide the lighting test voltage to a first pixel and a second pixel included in the first pixel row PX_L1 and the third pixel row PX_L3 and may detect the lighting defect of the first pixel and the second pixel. The first lighting test circuit 120 may alternately provide the lighting test voltage to the first pixel and the second pixel. The first lighting test circuit 120 may include a first transistor that provides a first lighting test voltage to the first pixel in response to a first test control signal and a second transistor that provides a second lighting test voltage to the second pixel in response to a second test control signal. The first transistor may turn on in response to the first test control signal and provide the first lighting test voltage to the first pixel in the lighting test process of the display panel 100. Further, the second transistor may turn on in response to the second test control signal and provide the second lighting test voltage to the second pixel in the lighting test process of the display panel 100.

The demultiplexer 140 may be formed in the non-display area NDA adjacent to the first lighting test circuit 120 in the first direction 1ST DIRECTION. The demultiplexer 140 may provide data signals to the pixel rows in the display area DA through the data lines DL when the display panel 100 is driven. The demultiplexer 140 may include a first control transistor that provides a data voltage/signal to the first pixel row PX_L1 and the third pixel row PX_L3 and a second control transistor that provides a data voltage/signal to the second pixel row PX_L2. The first control transistor may turn on in response to a first control signal provided from a first control line and may provide the data voltage to the first pixel row PX_L1 and the third pixel row PX_L3. The second transistor may turn on in response to a second control signal provided form a second control line and provide the data voltage to the second pixel row PX_L2.

The second lighting test circuit 160 may be formed in the non-display area adjacent to the demultiplexer 140 in the first direction 1ST DIRECTION. The second lighting test circuit 160 may provide a lighting test voltage to a pixel row through a data line DL in the lighting test process of the display panel 100. In some example embodiments, the second lighting test circuit 160 may provide a lighting test voltage to the first pixel row PX_L1 and the third pixel row PX_L3. The second lighting test circuit 160 may provide the lighting test voltage to first pixels and second pixels included in the first pixel row PX_L1 and the third pixel row PX_L3 and may detect the lighting defect of the first pixels and the second pixels. The second lighting test circuit 160 may alternately provide the lighting test voltage to the first pixels and the second pixels. The second lighting test circuit 160 may include a first transistor that provides the first lighting test voltage to the first pixel in response to the first test control signal and the second transistor that provides the second lighting test voltage to the second pixel in response to the second test control signal. The first transistor may turn on in response to the first test control signal and provide the first lighting test voltage to the first pixel in the lighting test process of the display panel 100. The second transistor may turn on in response to the second test control signal and provide the second lighting test voltage to the second pixel. In example embodiments, the second lighting test circuit 160 may provide a lighting test voltage to the second pixel row PX_L2. The second lighting test circuit 160 may provide the lighting test voltage to a third pixel included in the second pixel row PX_L2 and may detect the lighting defect of the third pixel. The second lighting test circuit 160 may include a third transistor that provides a third lighting test voltage to the third pixel in response to the third test control signal. The third transistor may turn on in response to the third test control signal and provide the third lighting test voltage to the third pixel in the lighting test process of the display panel 100.

The non-display area NDA may include a mounting area 180 of a data integrated circuit (IC) on which the data integrated circuit that provides the data signals is mounted. The mounting area 180 of the data integrated circuit may be disposed adjacent to the demultiplexer 140. The mounting area 180 may be a designated position for the data integrated circuit and/or may be a portion of a substrate of the display panel. Connecting lines CL that couples the data driving integrated circuit and the second lighting test circuit 160 to the demultiplexer 140 between the mounting area 180 of the data integrated circuit and the demultiplexer 140. The data integrated circuit may not be mounted on the mounting area 180 of the data integrated circuit in the lighting test process. The data integrated circuit may be mounted on the mounting area 180 of the data integrated circuit after the lighting test process. In example embodiments, the second lighting test circuit 160 may overlap (the mounting area 180 of) the data integrated circuit. The second lighting test circuit 160 may be positioned under the data integrated circuit after the data integrated circuit is mounted. In example embodiments, the second lighting test circuit 160 may be formed in a cutting area CA adjacent to the mounting area 180 of the data integrated circuit in the first direction 1ST DIRECTION as illustrated in FIG. 1B. The cutting area CA on which the second lighting test circuit may be cut/removed after the lighting test process of the display panel 100.

The display panel 100 according to example embodiments may include the first lighting test circuit 120 and the second lighting test circuit 160 formed in the non-display area NDA to perform the lighting test of the pixel rows formed in the display area DA. The second lighting test circuit 160 may overlap (the mounting area 180 of) the data integrated circuit or may be disposed in the cutting area CA that will be cut/removed after the lighting test process, so that the display area NDA may be minimized.

Figure 2:
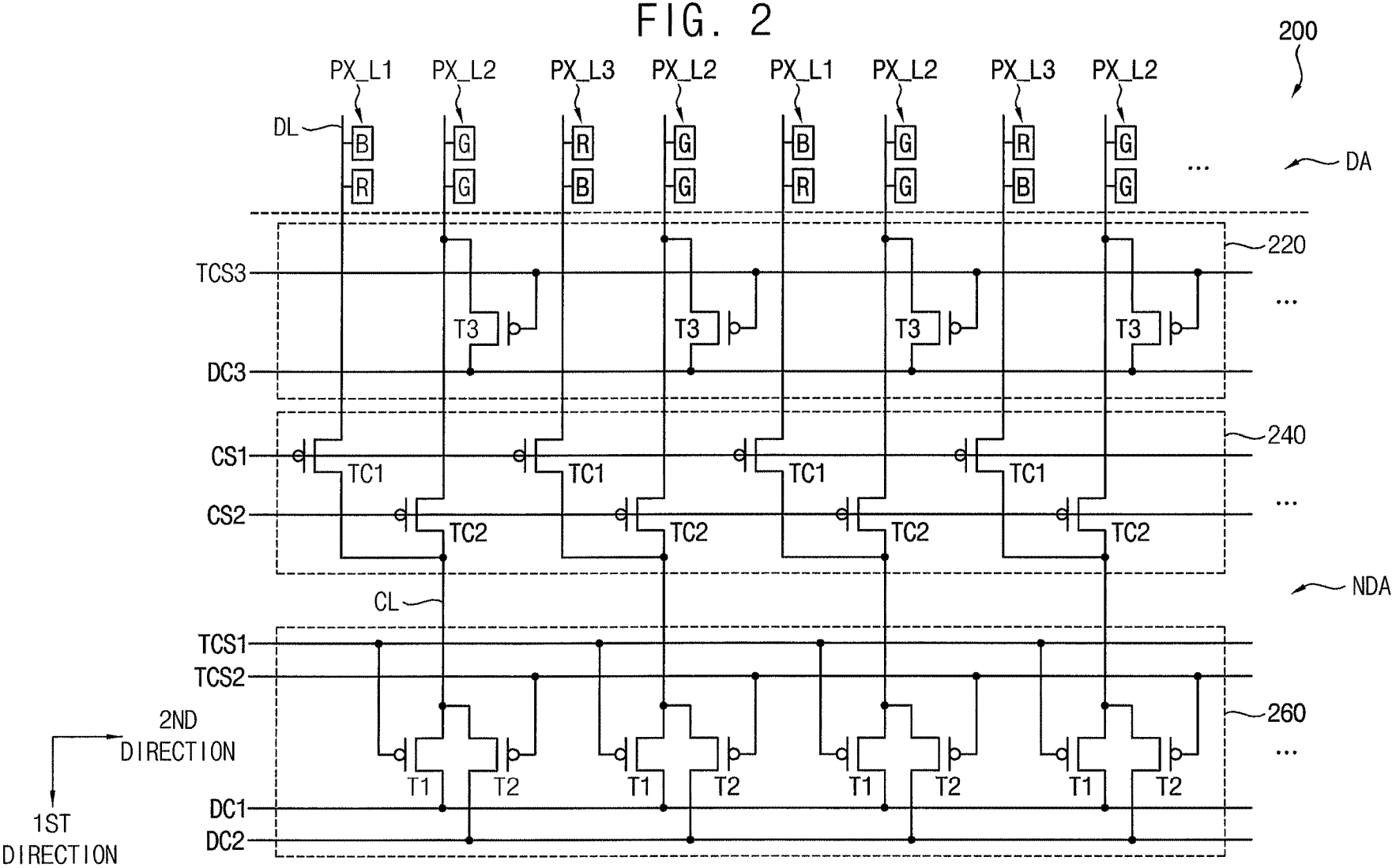
FIG. 2 is a diagram (e.g., a circuit diagram) illustrating a first lighting test circuit, a second lighting test circuit, and a demultiplexer included in the display panel of FIG. 1 according to example embodiments.
Figure 3:
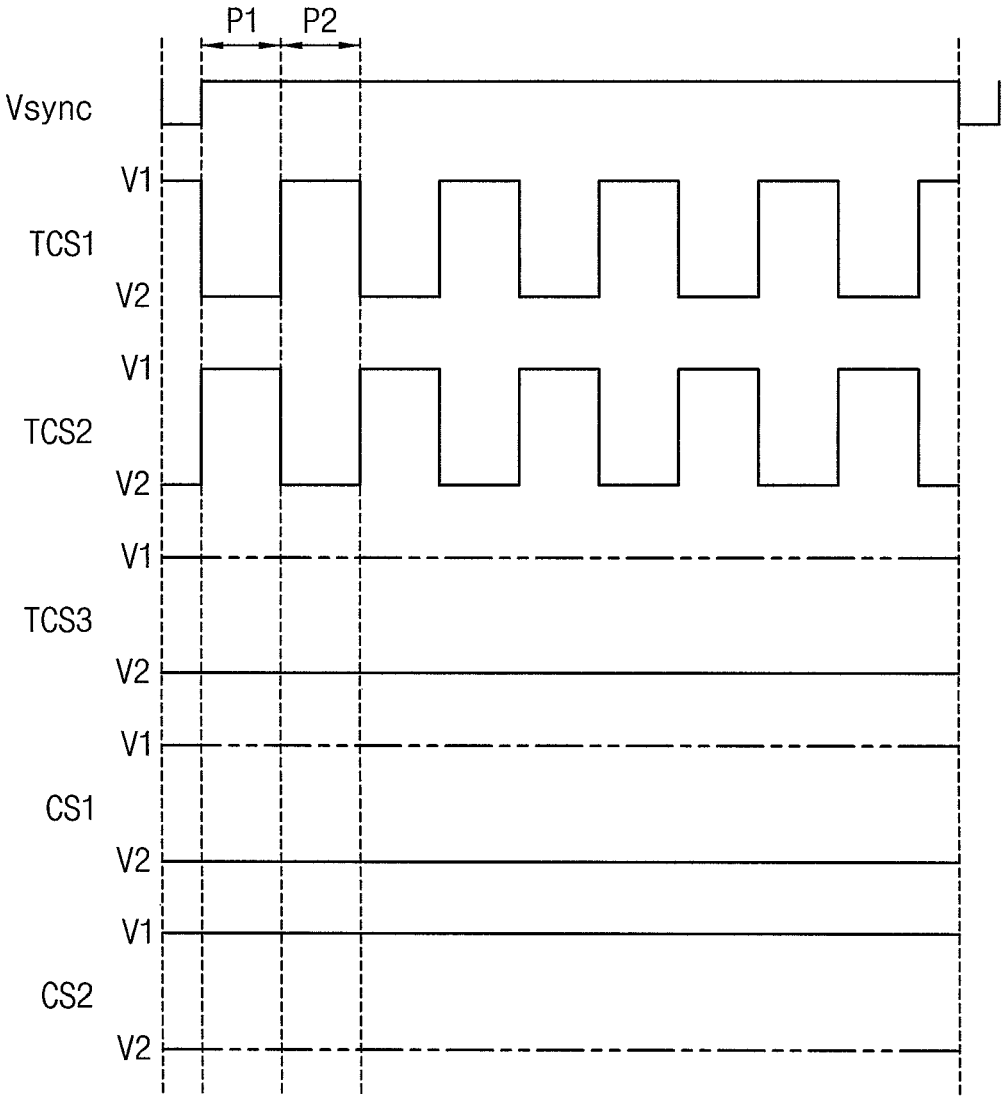
FIG. 3 is a timing diagram illustrating an operation of the first lighting test circuit, the second lighting test circuit, and the demultiplexer of FIG. 2 according to example embodiments.

FIG. 2 is a diagram illustrating an example of a first lighting test circuit, a second lighting test circuit, and a demultiplexer included in the display panel of FIG. 1 and FIG. 3 is a timing diagram illustrating for describing an operation of the first lighting test circuit, the second lighting test circuit, and the demultiplexer of FIG. 2.

The first pixel row PX_L1, the second pixel row PX_L2 and the third pixel row PX_L3 may be formed in the display area DA of the display panel 200. The first pixel row PX_L1 may include a first pixel R that displays the first color and a second pixel B that displays the second color that are alternately arranged. The second pixel row PX_L2 may include the third pixel G that displays the third color. The third pixel row PX_L3 may include the first pixel R and the second pixel B that are alternately arranged in an inverse order of the first pixel row PX_L1. For example, the first color may be the red, the second color may be the blue, and the third color may be the green. The first pixel row PX_L1, the second pixel row PX_L2, the third pixel row PX_L3, and the second pixel row PX_L2 may be repeatedly arranged in the second direction 2ND DIRECTION as illustrated in FIG. 2.

The first lighting test circuit 220, the demultiplexer 240, and the second lighting test circuit 260 may be arranged in the non-display area NDA of the display panel 200. The first lighting test circuit 220 may be formed the non-display area NDA adjacent to the display area DA in the first direction 1ST DIRECTION and the demultiplexer 240 may be formed in the non-display area NDA adjacent to the first lighting test circuit 220 in the first direction 1ST DIRECTION. The second lighting test circuit 260 may be formed adjacent to the demultiplexer 240. The connecting lines CL that couples the second lighting test circuit 260 and the demultiplexer 240 may be formed between the second lighting test circuit 260 and the demultiplexer 240. In some example embodiments, the second lighting test circuit 260 may overlap the mounting area of the data integrated circuit. In example embodiments, the second lighting test circuit 260 may be formed in the cutting line adjacent to the mounting area of the data integrated circuit in the first direction 1ST DIRECTION and may be cut/removed after the lighting test process.

The first lighting test circuit 220 may include third transistors T3 coupled to the data line DL of the second pixel row PX_L2. A gate electrode of the third transistor T3 may be coupled to a third test control line that provides the third test control signal TCS3, a first electrode of the third transistor T3 may be coupled to the data line DL of the second pixel row PX_L2, and the second electrode of the third transistor T3 may be coupled to a third voltage providing line that provides the third lighting test voltage DC3. The third test control signal TCS3 may have a voltage level that turns on or turns off the third transistor T3. The third lighting test voltage DC3 may have a voltage level that emits light the third pixel G included in the second pixel row PX_L2.

The demultiplexer 240 may include first control transistors TC1 coupled to the data line DL of the first pixel row PX_L1 and the data line DL of the third pixel row PX_L3 and second control transistors TC2 coupled to the data line DL of the second pixel row PX_L2. A gate electrode of the first control transistor TC1 may be coupled to the first control line, a first electrode of the first control transistor TC1 may be coupled to the data line DL of the first pixel row PX_L1 and the data line DL of the third pixel row PX_L3, and the second electrode may be coupled to the connecting line CL coupled to the second lighting test circuit 260. The first control signal CS1 may have a voltage level that turns on or turns off the first control transistor TC1. A gate electrode of the second control transistor TC2 may be coupled to a second control line, a first electrode of the second control transistor TC2 may be coupled to the data line DL of the second pixel row PX_L2, and a second electrode of the second control transistor TC2 may be coupled to the connecting line CL coupled to the second lighting test circuit 260. The second control signal CS2 provided form the second control signal may have a voltage level that turns on or turns off the second control transistor TC2.

The demultiplexer 240 may be coupled to the second lighting test circuit 260 through the connecting line CL. The second lighting test circuit 260 may include the first transistor T1 and the second transistor T2 coupled to the connecting line CL. A gate electrode of the first transistor T1 may be coupled to the first test control line that provides the first test control signal TCS1, a first electrode of the first transistor T1 may be coupled to the connecting line CL, and a second electrode of the first transistor may be coupled to a first voltage providing line that provides a first lighting test voltage DC1. The first test control signal TCS1 may have a voltage level that turns on or turns off the first transistor T1. The first lighting test voltage DC1 may have a voltage level that emits light the first pixel R included in the first pixel row PX_L1 and the third pixel row PX_L3. A gate electrode of the second transistor T2 may be coupled to the second test control line that provides the second test control signal TCS2, a first electrode of the second transistor T2 may be coupled to the connecting line CL, and a second electrode of the second transistor T2 may be coupled to a second voltage providing line that provides a second lighting test voltage DC2. The second test control signal TCS2 may have a voltage level that turns on or turns off the second transistor T2. The second lighting test voltage DC2 may have a voltage level that emits light the second pixel B included in the first pixel row PX_L1 and the third pixel row PX_L3.

Referring to FIG. 3, the first lighting test circuit 220, the demultiplexer 240, and the second lighting test circuit 260 may be operated in a first period P1 and a second period based on the first through third test control signal TCS1, TCS2, TCS3 and the first and second control signal CS1, CS2. The first through third test control signal TCS1, TCS2, TCS3 and the first and second control signal CS1, CS2 may have a first voltage level V1 and a second voltage level V2. For example, the first voltage level V1 may turn off the first through third transistors T1, T2, T3 and the first and second control transistors TC1, TC2. The second voltage level V2 may turn on the first through third transistors T1, T2, T3 and the first and second control transistors TC1, TC2.

In the first period P1, the third test control signal TCS3 having the second voltage level V2 may be provided to the first lighting test circuit 220, the first control signal CS1 having the second voltage level V2 and the second control signal CS2 having the first voltage level V1 may be provided to the demultiplexer 240, and the first test control signal TCS1 having the second voltage level V2 and the second test control signal TCS2 having the first voltage level V1 may be provided to the second lighting test circuit 260. In the first lighting test circuit 220, the third transistor T3 may turn on in response to the third test control signal TCS3 having the second voltage level V2. The third lighting test voltage DC3 may be provided to the data line dl of the second pixel row PX_L2 when the third transistor T3 turns on. Thus, the third pixels G included in the second pixel row PX_L2 may emit light. In the second light test circuit 260, the first transistor T1 may turn on in response to the first test control signal TCS1 having the second voltage level V2 and the second transistor T2 may turn off in response to the second test control signal TCS2 having the first voltage level V1. The first lighting test voltage DC1 may be provided to the connecting line CL through the first transistor T1 when the first transistor T1 turns on. In the demultiplexer 240, the first control transistor TC1 may turn on in response to the first control signal CS1 having the second voltage level V2, the second transistor T2 may turn off in response to the second control signal CS2 having the first voltage level V1. The first lighting test voltage DC1 provided through the connecting line CL may be provided to the data line DL of the first pixel row PX_L1 or third pixel row PX_L3 through the first control transistor TC1. The first pixels R included in the first pixel row PX_L1 and the third pixel row PX_L3 because the first lighting test voltage DC1 has the voltage level that emits the first pixels R.

In the second period P2, the third test control signal TCS3 having the second voltage level V2 may be provided to the first lighting test circuit 220, the first control signal having the second voltage level V2 and the second control signal CS2 having the first voltage level V1 may be provided to the demultiplexer, and the first test control signal TCS1 having the first voltage level V1 and the second test control signal TCS2 having the second voltage level V2 may be provided to the second lighting test circuit 260. In the first lighting test circuit 220, the third transistor T3 may turn on in response to the third test control signal TCS3 having the second voltage level V2. The third lighting test voltage DC3 may be provided to the data line DL of the second pixel row PX_L2 when the third transistor T3 turns on. Thus, the third pixels G included in the second pixel row pixel row PX_L2 may emit light. In the second lighting test circuit 260, the first transistor T1 may turn off in response to the first test control signal TCS1 having the first voltage level V1 and the second transistor T2 may turn on in response to the second test control signal TCS2 having the second voltage level V2. The second lighting test voltage DC2 may be provided to the connecting line CL through the second transistor T2 when the second transistor T2 turns on. In the demultiplexer 240, the first control transistor TC1 may turn on in response to the first control signal CS1 having the second voltage level V2, and the second control transistor turn off in response to the second control signal CS having the first voltage level V1. The second lighting test voltage DC2 provided through the connecting line CL may be provided to the data line DL of the first pixel row PX_L1 or the third pixel row PX_L3 through the first control transistor TC1. The second pixels B included in the first pixel row PX_L1 and the third pixel row PX_L3 may emit light because the second lighting test voltage DC2 has the voltage level that emits the second pixel B.

The lighting defect(s) of the first pixels R and the third pixels G may be detected in the first period P1 during which the first pixels R and the third pixels G emit light. The lighting defect(s) of the second pixels B and the third pixels G may be detected in the second period during which the second pixels B and the third pixels G emit light.

The display panel may include the separate first lighting test circuit 220 and the second lighting test circuit 260 that are separate from each other for the lighting test of the first pixel R, the second pixel B, and the third pixel G. The second lighting test circuit 260 may overlap the mounting area of the data integrated circuit or may be formed in the cutting area. Thus, the non-display area of the display panel 200 may be minimized.

Figure 4:
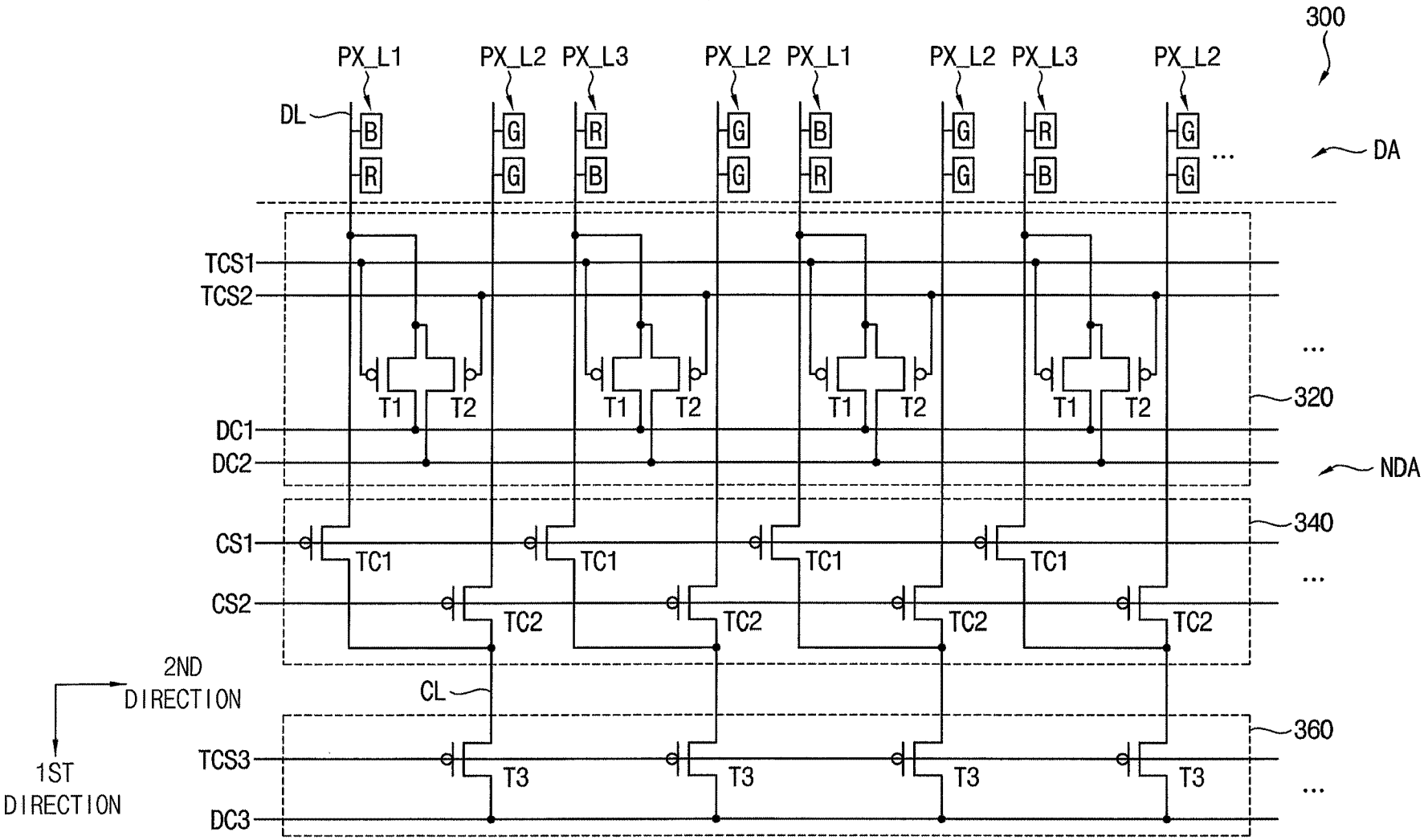
FIG. 4 is a diagram illustrating a first lighting test circuit, a second lighting test circuit, and a demultiplexer included in the display panel of FIG. 1 according to example embodiments.
Figure 5:
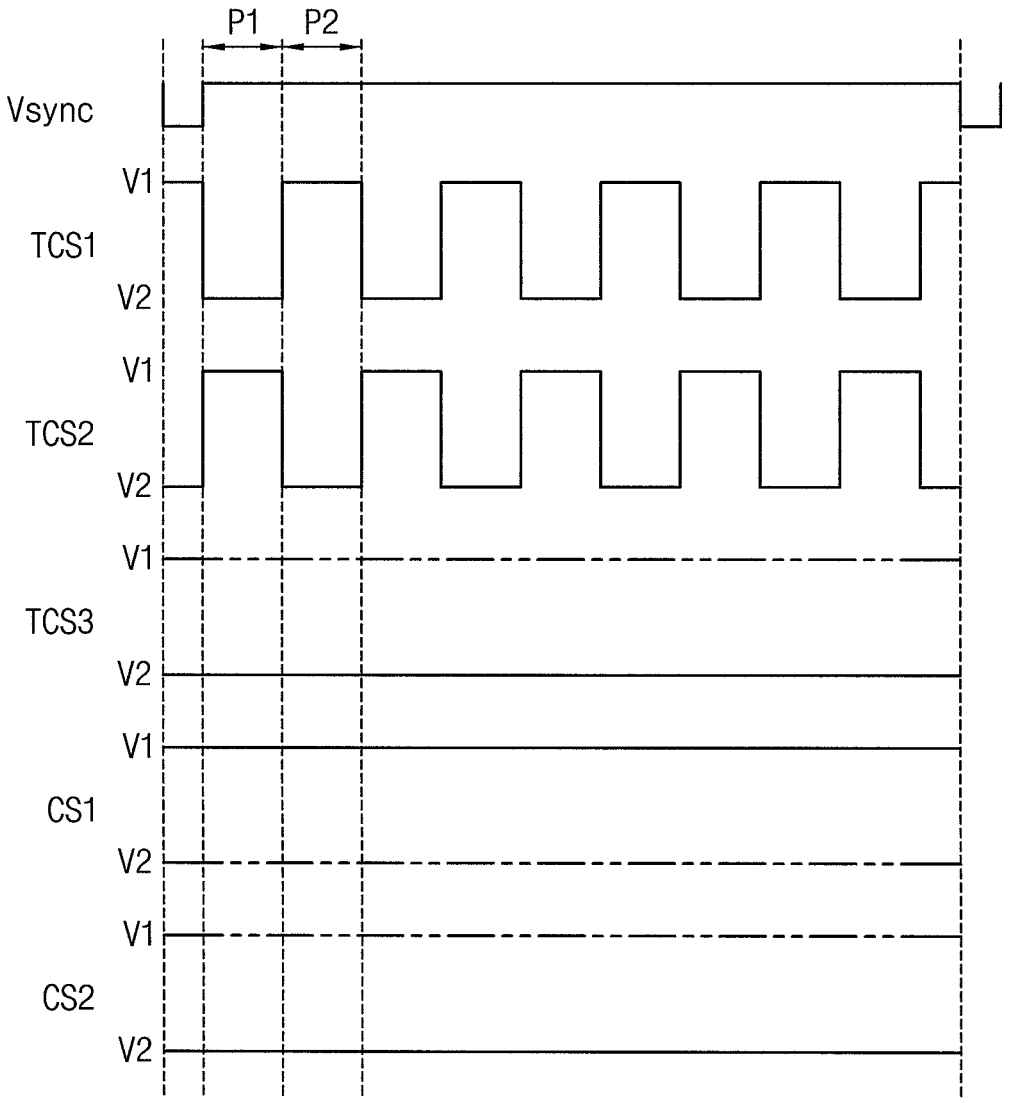
FIG. 5 is a timing diagram illustrating an operation of the first lighting test circuit, the second lighting test circuit, and the demultiplexer of FIG. 4 according to example embodiments.

FIG. 4 is a diagram illustrating a first lighting test circuit, a second lighting test circuit, and a demultiplexer included in the display panel of FIG. 1. FIG. 5 is a timing diagram illustrating for describing an operation of the first lighting test circuit, the second lighting test circuit, and the demultiplexer of FIG. 4.

Referring to FIG. 4, the display panel 300 may include the display area DA and the non-display area.

The first pixel row PX_L1, the second pixel row PX_L2 and the third pixel row PX_L3 may be formed in the display area DA of the display panel 300. The first pixel row PX_L1 may include a first pixel R that displays the first color and a second pixel B that displays the second color that are alternately arranged. The second pixel row PX_L2 may include the third pixel G that displays the third color. The third pixel row PX_L3 may include the first pixel R and the second pixel B that are alternately arranged in an inverse order of the first pixel row PX_L1. For example, the first color may be the red, the second color may be the blue, and the third color may be the green. The first pixel row PX_L1, the second pixel row PX_L2, the third pixel row PX_L3, and the second pixel row PX_L2 may be repeatedly arranged in the second direction 2ND DIRECTION as illustrated in FIG. 4.

The first lighting test circuit 320, the demultiplexer 340, and the second lighting test circuit 360 may be arranged in the non-display area NDA of the display panel 300. The first lighting test circuit 320 may be formed the non-display area NDA adjacent to the display area DA in the first direction 1ST DIRECTION and the demultiplexer 340 may be formed in the non-display area NDA adjacent to the first lighting test circuit 320 in the first direction 1ST DIRECTION. The second lighting test circuit 360 may be formed adjacent to the demultiplexer 340. The connecting lines CL that couples the second lighting test circuit 360 and the demultiplexer 340 may be formed between the second lighting test circuit 360 and the demultiplexer 340. In example embodiments, the second lighting test circuit 360 may overlap the mounting area of the data integrated circuit. In example embodiments, the second lighting test circuit 360 may be formed in the cutting line adjacent to the mounting area of the data integrated circuit in the first direction 1ST DIRECTION and may be cut/removed after the lighting test process.

The first lighting test circuit 320 may include a first transistors T1 and the second transistors T2 coupled to the data line DL coupled to the first pixel row PX_L1 and the data line DL of the third pixel row PX_L3. A gate electrode of the first transistor T1 may be coupled to a first test control line that provides the first test control signal TCS1, a first electrode of the first transistor T1 may be coupled to the data line DL of the first pixel row PX_L1 and the third pixel row PX_L3, a second electrode of the first transistor T1 may be coupled to the first voltage providing line that provides the first lighting test voltage DC1. The first test control signal TCS1 may have the voltage level that turns on or turns off the first transistor T1. The first lighting test voltage DC1 may have the voltage level that emits light the first pixel R included in the first pixel row PX_L1 and the third pixel row PX_L3. A gate electrode of the second transistor may be coupled to the second test control line that provides the second test control signal TCS2, a first electrode of the second transistor may be coupled to the data line DL of the first pixel row PX_L1 and the third pixel row PX_L3, and a second electrode of the second transistor T2 may be coupled to the second voltage providing line that provides the second lighting test voltage DC2. The second test control signal TCS2 may have the voltage level that turns on or turns off the second transistor T2. The second lighting test voltage DC2 may have the voltage level that emits light the second pixel B included in the first pixel row PX_L1 and the third pixel row PX_L3.

The demultiplexer 320 may include first control transistors TC1 coupled to the data lines DL of the first pixel row PX_L1 and the third pixel row PX_L3 and second transistors TC2 coupled to the data lines DL of the second pixel row PX_L2. A gate electrode of the first control transistor TC1 may be coupled to the first control line, a first electrode of the first control transistor TC2 may be coupled to the data lines DL of the first pixel row PX_L1 and the third pixel row PX_L3, a second electrode of the first control transistor TC1 may be coupled to the connecting line CL coupled to the second lighting test circuit 360. The first control signal CS1 may have the voltage level that turns on or turns off the first control transistor TC1. A gate electrode of the second control transistor TC2 may be coupled to the second control line, a first electrode of the second control transistor TC2 may be coupled to the data line DL of the second pixel row PX_L2, and a second electrode of the second control transistor TC2 may be coupled to the connecting line CL coupled to the second lighting test circuit 360. The second control signal CS may have a voltage level that turns on or turns off the second transistor TC2.

The demultiplexer 340 may the second lighting test circuit 360 may be coupled through the connecting line CL. The second lighting test circuit 360 may include the third transistor T3 coupled to the connecting line CL. A gate electrode of the third transistor T3 may be coupled to the third test control line that provide the third test control signal TCS3, a first electrode of the third transistor T3 may be coupled to the connecting line CL, and a second electrode of the third transistor T3 may be coupled to the third voltage providing line that provides the third lighting test voltage CD3. The third test control signal TCS3 may have a voltage level that turns on or turns off the third transistor T3. The third lighting test voltage may have a voltage level that emit lights the second pixel B included in the second pixel row PX_L2.

Referring to FIG. 5, the first lighting test circuit 320, the demultiplexer 340, and the second lighting test circuit 360 may be operated in the first period P1 and the second period P2 based on the first through third test control signal TCS1, TCS2, TCS3 and the first and second control signal CS1, CS2. The first through third test control signal TCS1, TCS2, TCS3 and the first and second control signal CS1, CS2 may have the first voltage level V1 and the second voltage level V2. For example, the first voltage level V1 may turn off the first through third transistors T1, T2, T3 and the first and second control transistors TC1, TC2. The second voltage level V2 may turn on the first through third transistors T1, T2, T3 and the first and second control transistors TC1, TC2.

In the first period P1, the first test control signal TCS1 having the second voltage level V2 and the second test control signal TCS2 having the first voltage level V1 may be provided to the first lighting test circuit 320, the first control signal CS1 having the first voltage level V1 and the second control signal CD2 having the second voltage level V2 may be provided to the demultiplexer 340, and the third test control signal TCS3 having the second voltage level V2 may be provided to the second lighting test circuit 360. In the first lighting test circuit 320, the first transistor T1 may turn on in response to the first test control signal TCS1 having the second voltage level V2, the second transistor T2 may turn off in response to the second test control signal TCS2 having the first voltage level V1. The first lighting test voltage DC1 may be provided to the data line of the first pixel row PX_L1 and the third pixel row PX_L3 when the first transistor T1 turns on. The first pixels R included in the first pixel row PX_L1 and the third pixel row PX_L3 may emit light because the first lighting test voltage DC1 has the voltage level that emits light the first pixels R. In the second lighting test circuit 360, the third transistor T3 may turn on in response to the third test control signal TCS3 having the second voltage level V2. The third lighting test voltage DC3 may be provided to the third transistor T3 through the connecting line CL when the third transistor T3 turns on. In the demultiplexer 340, the first control transistor TC1 may turn off in response to the first control signal CS1 having the first voltage level V1 and the second control transistor TC2 may turn on in response to the second control signal CS2 having the second voltage level. The third lighting test voltage DC3 provided through the connecting line CL may be provided to the data line DL of the second pixel row PX_L2 through the second control transistor when the second control transistor TC2 turns on. The third pixels G included in the second pixel row PX_L2 may emit light because the third lighting test voltage DC3 has the voltage level that emits light the third pixels G.

In the second period P2, the first test control signal TCS1 having the first voltage level V1 and the second test control signal TCS2 having the second voltage level V2 to the first lighting test circuit 320, the first control signal CS1 having the first voltage level V1 and the second control signal CS2 having the second voltage level V2 may be provided to the demultiplexer 340, and the third control signal TCS3 having the second voltage level V2 may be provided to the second lighting test circuit 360. In the first lighting test circuit 320, the first transistor may turn off in response to the first test control signal TCS1 having the first voltage level V1, and the second transistor T2 may turn on in response to the second test control signal TCS2 having the second voltage level V2. The second lighting test voltage DC2 may be provided to the data line DL of the first pixel row PX_L1 and the third pixel row PX_L3 when the second transistor T2 turns on. The second pixels B included in the first pixel row PX_L1 and the third pixel row PX_L3 may emit light because the second lighting test voltage DC2 has the voltage level that emits light the second pixels B. In the second lighting test circuit 360, the third transistor T3 may turn on in response to the third test control signal TCS3 having the second voltage level V2. The third lighting test voltage DC3 may be provided to the connecting line CL through the third transistor T3 when the third transistor T3 turns on. In the demultiplexer 340, the first control transistor TC1 may turn off in response to the first control signal CS1 having the first voltage level V1 and the second control transistor TC2 may turn on in response to the second control signal CS2 having the second voltage level V2. The third lighting test voltage DC3 provided through the connecting line CL may be provided to the data line DL of the second pixel row PX_L2 through the second control transistor TC2 when the second control transistor TC2 turns on. The third pixels G included in the second pixel row PX_L2 may emit light because the third lighting test voltage CD3 has the voltage level that emits light the third pixels B.

In the lighting test process of the display panel 300, the lighting defect(s) of the first pixels R and the third pixels G may be detected during the first period P1, and the lighting defect(s) of the second pixels B and the third pixels G may be detected during the second period P2.

The display panel may include the first lighting test circuit 320 and the second lighting test circuit 360 that are separate from each other for the lighting test of the first pixel R, the second pixel B, and the third pixel G. The second lighting test circuit 360 may overlap (the mounting area of) the data integrated circuit or may be formed in the cutting area. Thus, the non-display area of the display panel 300 may be minimized.

Figure 6:
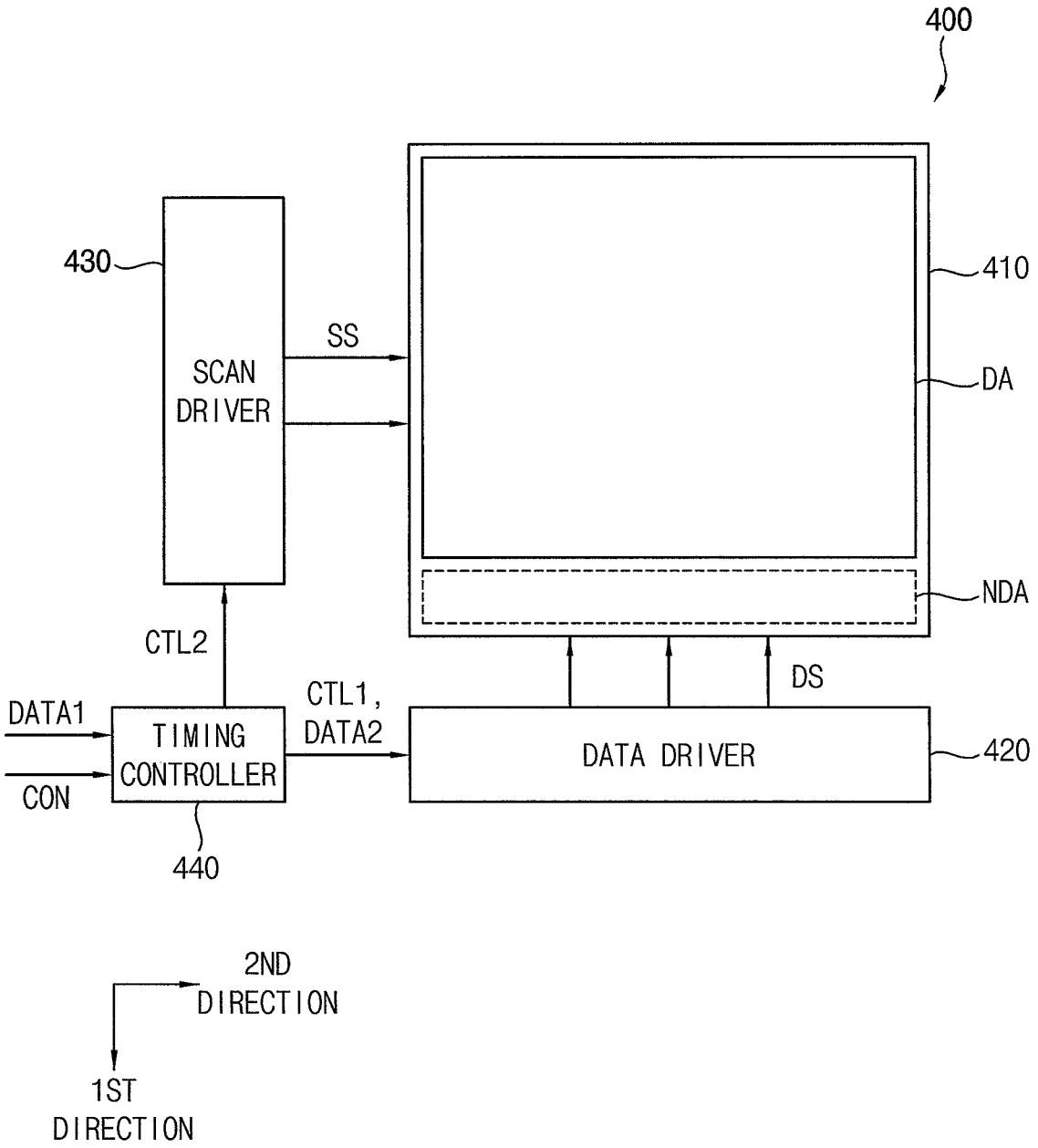
FIG. 6 is a block diagram illustrating a display device according to example embodiments.

FIG. 6 is a block diagram illustrating a display device according to example embodiments.

Referring to FIG. 6, the display device 400 may include a display panel 410, a data driver 420, a scan driver 430, and a timing controller 440.

The display panel 410 may include a display area DA and a non-display area NDA. A plurality of data lines that extends in a first direction 1ST DIRECTION and arranged in a second direction 2ND DIRECTION perpendicular to the first direction 1ST DIRECTION may be formed in the display area DA. The first direction 1ST DIRECTION may be perpendicular to an upper side of the display panel 410 and the second direction 2ND DIRECTION may be parallel to the upper side of the display panel 410. Each of the data lines may be electrically coupled to pixel row. Each of the pixels rows may be arrange in parallel to the data line. Pixels included in each of the pixel rows may emit light in response to a lighting test voltage provided through the data lines in a lighting test process of the display panel 410. The display area DA may include a first pixel row, a second pixel row, and a third pixel row. The first pixel row may include a first pixel that displays a first color and a second pixel that displays a second color. The first pixel and the second pixel included in the first pixel row may be alternately arranged. The second pixel row may include a third pixel that displays a third color. The third pixel row may include the first pixel and the second pixel. The first pixel and the second pixel included in the third pixel row may be alternately arranged in an inverse order of the first pixel row. For example, the first color may be red, the second color may be blue, and the third color may be green. For example, the display area DA may have a layout in which the first pixel row, the second pixel row, the third row, and the second row are repeatedly arranged in the second direction 2ND DIRECTION. Further, a plurality of scan lines that extends in the second direction 2ND DIRECTION and arranged in the first direction 1ST DIRECTION may be formed in the display area DA. Each of the pixels included in the pixel row may be disposed in an intersection region of the data line and the scan line.

The non-display area NDA may surround the display area DA. The first lighting test circuit, the demultiplexer, and the second lighting test circuit may be formed in the non-display area NDA. The first lighting test circuit may be formed in the non-display area NDA adjacent to the display area DA in the first direction 1ST DIRECTION. The first lighting test circuit may provide the lighting test voltage to the pixels row of the display area DA through the data line in the lighting test process of the display panel 410. The demultiplexer may be formed in the non-display area NDA adjacent to the first lighting test circuit in the first direction 1ST DIRECTION. The demultiplexer may provide the data signal DS to the pixels row of the display area DA through the data line when the display panel 410 is driven. The second lighting test circuit may be formed in the non-display area NDA adjacent to the demultiplexer in the first direction 1ST DIRECTION. The second lighting test circuit may provide the lighting test voltage to the pixel rows through the data line in the lighting test process of the display panel 410. The non-display area NDA may include a mounting area of a data integrated circuit that provides the data signal DS. Connecting lines that couples the data driving integrated circuit and the second lighting test circuit may be disposed between the mounting area of the data driving integrated circuit and the demultiplexer. In example embodiments, the second lighting test circuit may overlap (the mounting area of) the data integrated circuit. In example embodiments, the second lighting test circuit may be formed in a cutting area adjacent to the mounting area of the data integrated circuit in the first direction 1ST DIRECTION.

In example embodiments, the first lighting test circuit may provide the lighting test voltage to the second pixel and the second lighting test circuit may provide the lighting test voltage to the first pixel row and the third pixel row. The first lighting test circuit may provide the third lighting test voltage to the second pixel row in response to the third test control signal. The third pixels included in second pixel row may emit light in response to the third lighting test voltage. The second lighting test circuit may provide the first lighting test voltage to the demultiplexer through the connecting line in response to the first test control signal or provide the second lighting test voltage to the demultiplexer through the connecting line in response to the second test control signal. The first test control signal and the second test control signal may be alternately provided to the second lighting test circuit. The demultiplexer may provide the first lighting test voltage or the second lighting test voltage provided through the connecting line to the first pixel row and the third pixel row in response to the first control signal. The first pixels included in the first pixel row and the third pixel row may emit light in response to the first lighting test voltage and the second lighting test circuit may emit light in response to the second lighting test voltage. In the second lighting test circuit, the first lighting test voltage and the second lighting test voltage may be alternately provided to the first pixel row and the third pixel row. Thus, first pixels and the third pixels included in the first pixel row and the third pixel row may alternately emit light.

In example embodiments, the first lighting test circuit may provide the lighting test voltage to the first pixel row and the third pixel row and the second lighting test circuit may provide the lighting test voltage to the second pixel row. The first lighting test circuit may provide the first lighting test voltage to the first pixel row and the third pixel row in response to the first test control signal or provide the second lighting test voltage to the first pixel row and the third pixel row in response to the second test control signal. The first test control signal and the second test control signal may be alternately provided to the first lighting test circuit. The first pixels included in the first pixel row and the third pixel row may emit light in response to the first lighting test voltage and the second pixel may emit light in response to the second lighting test voltage. The first lighting test voltage and the second lighting test voltage may be alternately provided to the pixel row and the third pixel row because the first test control signal and the second test control signal are alternately provided to the first lighting test circuit. Thus, the first pixels and the third pixels included in the first pixel row and the third pixel row may alternately emit light. The second lighting test circuit may provide the third lighting test voltage to the demultiplexer through the connecting line in response to the third test control signal. The demultiplexer may provide the third lighting test voltage to the second pixel row in response to the second control signal. The third pixels included in the second pixel row may emit light in response to the third lighting test voltage.

The data driver 420 may generate the data signal DS provided to the pixel rows when the display device 400 is driven. The data driver 420 may generate the data signal DS based on a second image data signal DATA2 and a first timing control signal CTL1 provided from the timing controller 440 and provide the data signal DS to the pixel rows through the data line in the 410. The data driver 420 may be implemented as the data integrated circuit. The data integrated circuit may be mounted in the mounting area. The data integrated circuit may be mounted on the mounting area after the lighting test process of the display device 400.

The scan driver 430 may generate the scan signal SS provided to the pixel rows. The scan driver 430 may generate the scan signal SS based on the second timing control signal CTL2 provided from the timing controller 440 and provide the scan signal SS to the pixel rows through the scan lines in the display panel 410. The scan line may be formed in a perpendicular direction to the data line. The scan driver 430 may be formed in the non-display area NDA of the display panel 410. Alternatively, the scan driver 430 may be implemented as an integrated circuit and be mounted on the non-display area NDA. Alternatively the scan driver 430 may be implemented as a chip on film (COF) and be mounted on the non-display area NDA.

The timing controller 440 may receive a timing control signal CON from an external device and generate the first timing control signal CTL1 and the second timing control signal CTL2 that control a timing of the data driver 420 and the scan driver 430. Further, the timing controller 440 may receive the first image data DATA1 from the external device and convert the first image data DATA1 to the second image data DATA2. The timing controller 440 may provide the first image data DATA1 as the second image data DATA2. Alternatively, the timing controller 440 may provide the second image data to the data driver 420 by compensating the first image data DATA1.

The display device 400 according to example embodiments may include the first lighting test circuit and the second lighting test circuit formed in the non-display area NDA for the lighting test of the pixel rows formed in the display area DA of the display panel 410. The non-display area NDA (i.e., the dead space) may decrease by arranging the second lighting test circuit in an area overlapped with the mounting area of the data integrated circuit or in the cutting area that is cut after the lighting test process.

Figure 7A:
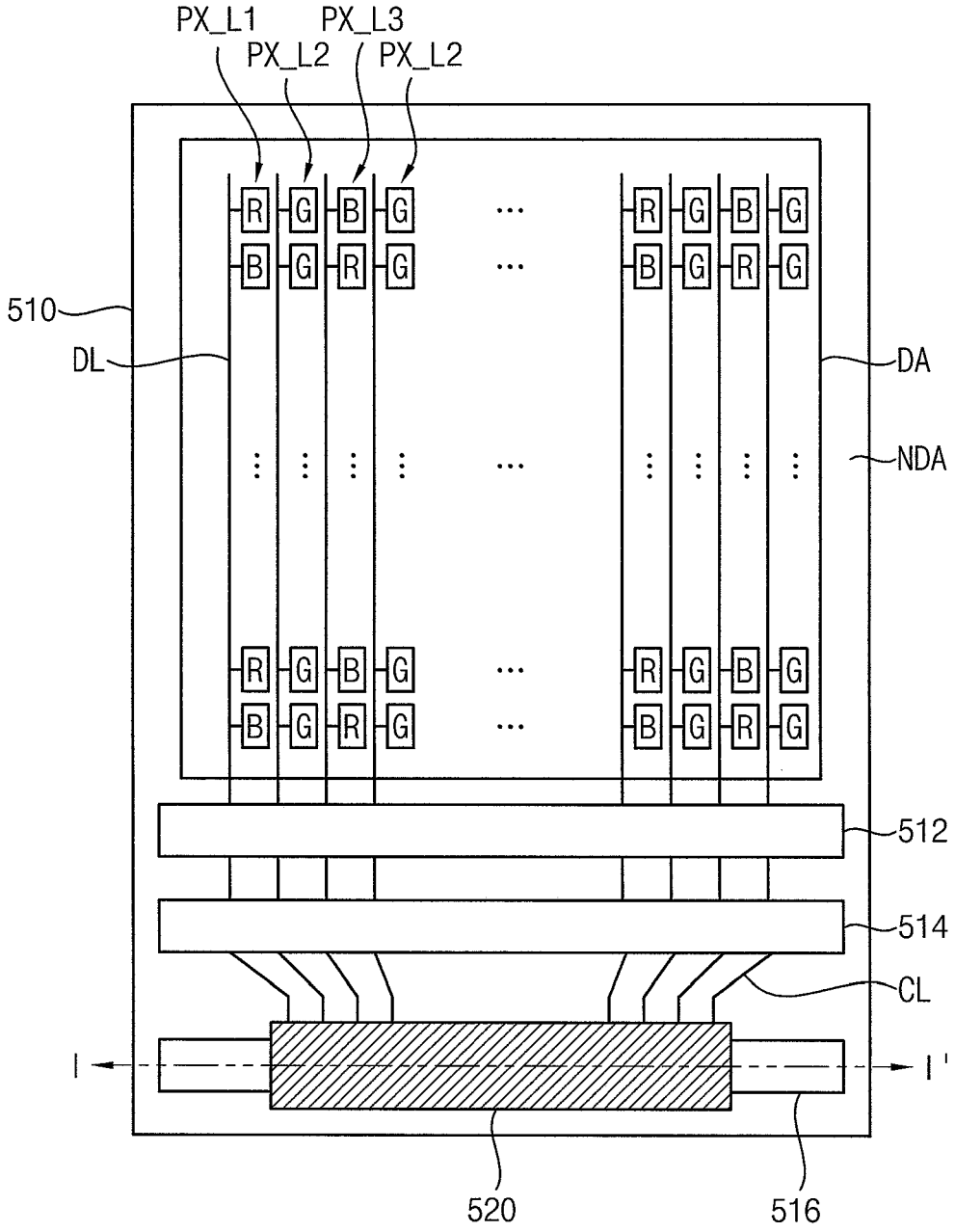
FIG. 7A is a diagram illustrating a display panel included in the display device of FIG. 6 according to example embodiments.
Figure 7B:
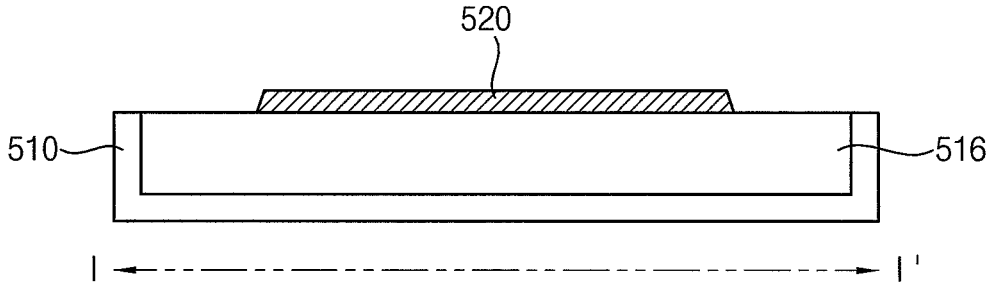
FIG. 7B is a cross-sectional diagram illustrating a cross section of display panel according to example embodiments.

FIG. 7A is a diagram illustrating an example of a display panel included in the display device of FIG. 6 and FIG. 7B is a cross-sectional diagram illustrating a cross section of display panel.

Referring to FIG. 7A, the display panel 510 of the display device may include the display area DA and the non-display area NDA. The plurality of pixel rows PX_L1, PX_L2, PX_L3 and the data lines DL may be formed in the display area DA. The first lighting test circuit 512 formed adjacent to a side of the display area DA, a demultiplexer 514 formed adjacent to a side of the first lighting test circuit 512, and a second lighting test circuit 516 formed adjacent to a side of the demultiplexer 514 in the non-display area NDA. The second lighting test circuit 516 may overlap the mounting area and/or overlap the data integrated circuit 516. The second lighting test circuit 516 may be formed under the mounting area of the data integrated circuit 520 and may be positioned between the data integrated circuit 520 and a substrate of the display panel 510 as illustrated in FIG. 7B. The data integrated circuit 520 may not be mounted on the display panel 510 during the lighting test process and may be mounted after the lighting test process. The second lighting test circuit 516 may overlap the mounting area of the data integrated circuit so that the non-display area NDA of the display panel 510 may be minimized.

Figure 8A:
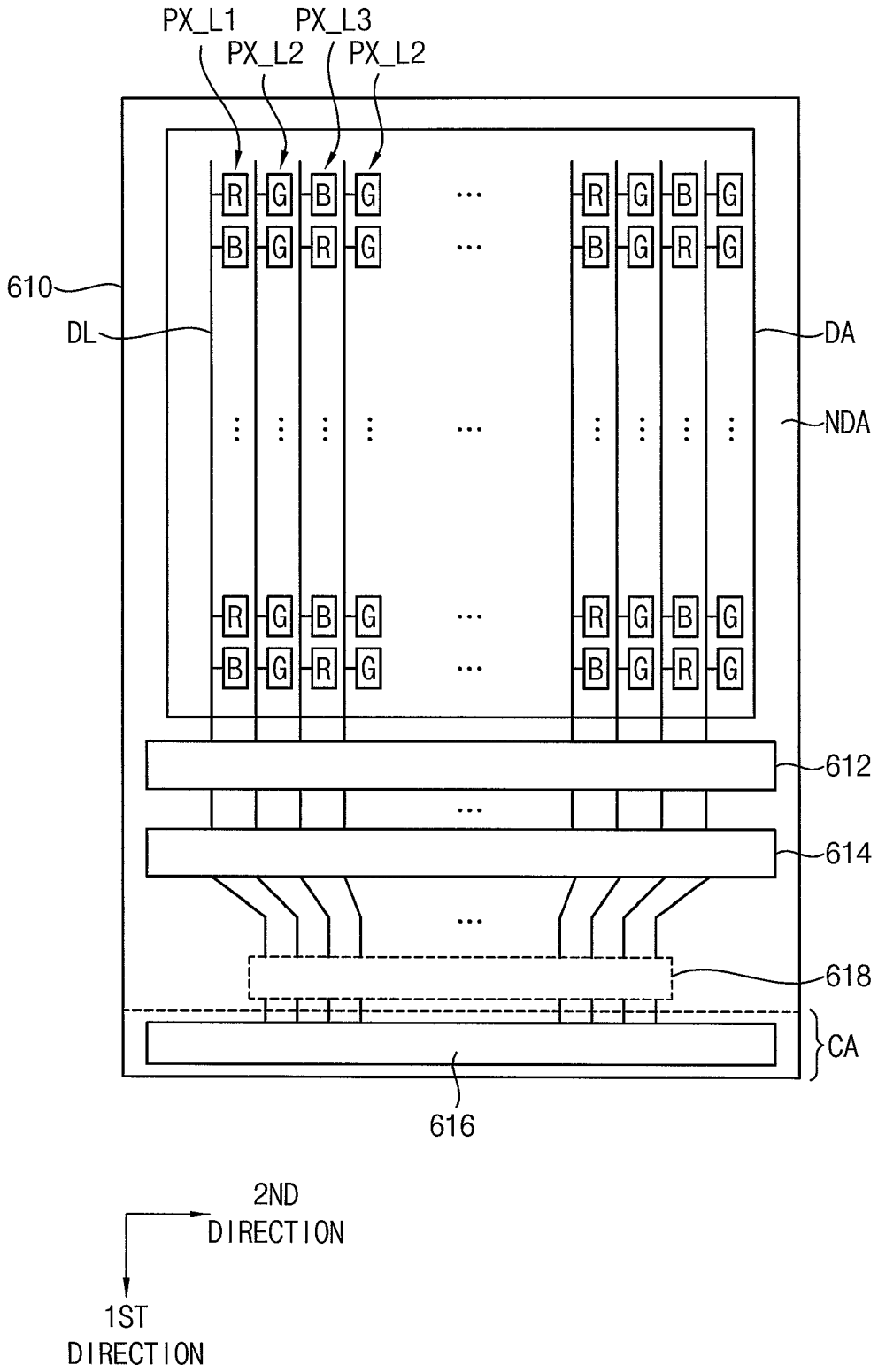
FIG. 8A is a diagram illustrating a display panel included in the display device of FIG. 6 according to example embodiments.
Figure 8B:
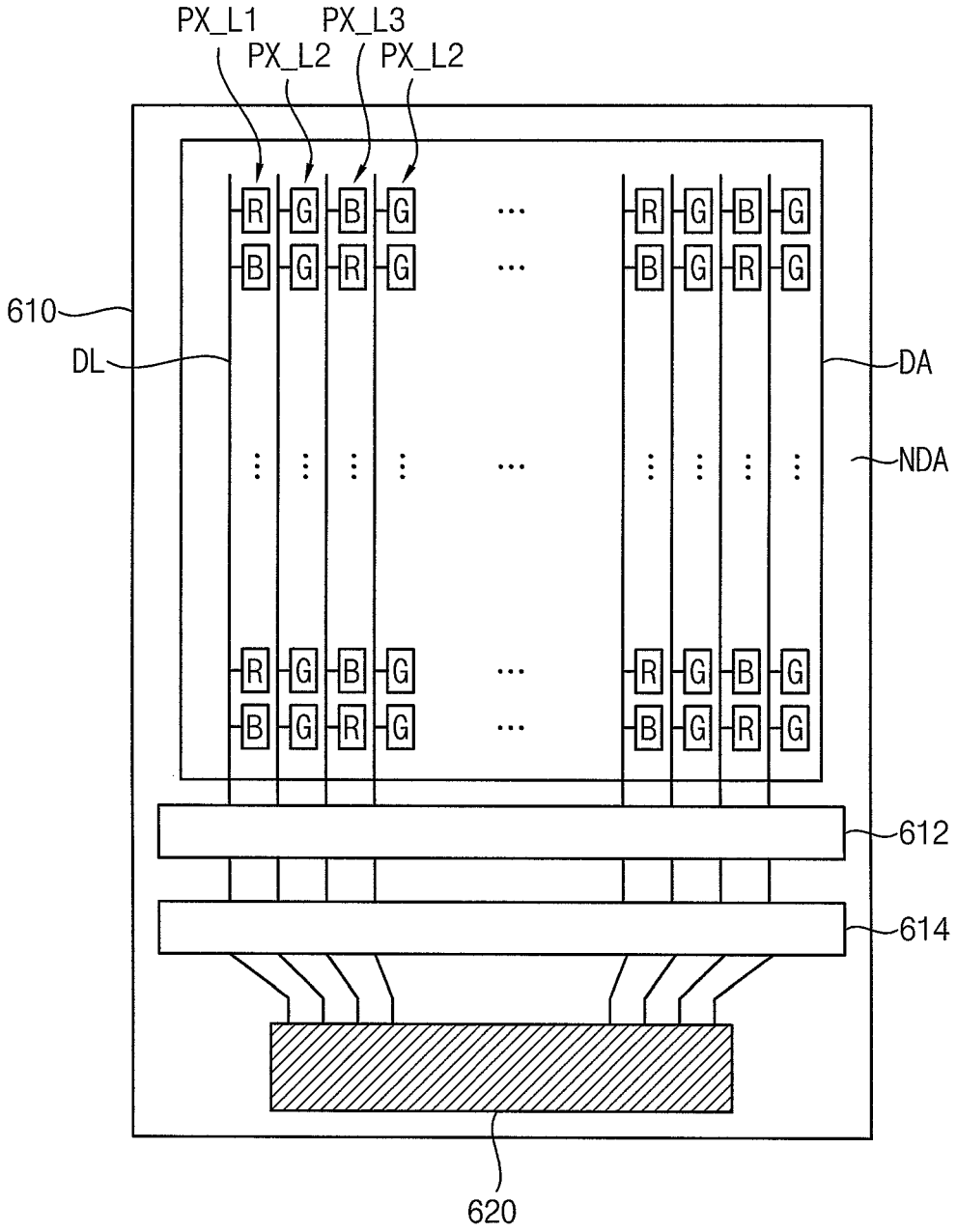
FIG. 8B is a diagram illustrating the display panel of FIG. 8A from which a second lighting test circuit has been removed after a lighting test process according to example embodiments.

FIG. 8A is a diagram illustrating a display panel included in the display device of FIG. 6 and FIG. 8B is a diagram illustrating the display panel of FIG. 8A in which a second lighting test circuit is cut after a lighting test process.

Referring to FIG. 8A, the display panel 610 of the display device may include the display area DA and the non-display area NDA. The plurality of pixel rows PX_L1, PX_L2, PX_L3 and the data lines DL may be formed in the display area DA. The first lighting test circuit 612 formed adjacent to a side of the display area DA, a demultiplexer 614 formed adjacent to a side of the first lighting test circuit 612, and a second lighting test circuit 616 formed adjacent to a side of the demultiplexer 514 in the non-display area NDA. The second lighting test circuit 616 may be formed in the cutting area CA adjacent to a side of the mounting area 618 of the data integrated circuit. The cutting area may be cut/removed and the data integrated circuit 620 may be mounted on the mounting area 618 of the data integrated circuit after the lighting test process of the display device as illustrated in FIG. 8B. The second lighting test circuit 616 may be formed in the cutting area CA and may be cut/removed after the lighting test process, so that the non-display area NDA of the display panel 610 may decrease.

Embodiments may be applied to a display device and an electronic device having the display device. For example, embodiments may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting. Although a few example embodiments have been described, those skilled in the art will readily appreciate that many modifications are possible in the example embodiments. Accordingly, all such modifications are intended to be included within the scope defined in the claims.

What is claimed is:

1. A display panel comprising:

a first data line and a second data line each extending in a first direction;

a first pixel group electrically connected to the first data line;

a second pixel group electrically connected to the second data line;

a first lighting test circuit configured to provide a first lighting test voltage to at least one of a pixel of the first pixel group and a pixel of the second pixel group through at least one of the first data line and the second data line;

a demultiplexer comprising a first control transistor electrically connected to the first data line, comprising a second control transistor electrically connected to the second data line, and configured to provide data signals to the first pixel group and the second pixel group through the first data line and the second data line, respectively, wherein a total number of test transistors of the first lighting test circuit is less than or equal to a total number of control transistors of the demultiplexer; and a second lighting test circuit comprising a first test transistor and configured to provide a second lighting test voltage to one or more of the pixel of the first pixel group and the pixel of the second pixel group through one or more of the first data line and the second data line, wherein at least one of the first lighting test circuit and the demultiplexer is positioned between the second lighting test circuit and the first pixel group in the first direction, wherein the first lighting test circuit is positioned between the demultiplexer and the first pixel group in the first direction, and wherein the first test transistor is electrically connected through no intervening transistor to each of the first control transistor and the second control transistor.

2. The display panel of claim 1, further comprising: a data integrated circuit configured to provide the data signals to the demultiplexer, wherein the demultiplexer is positioned between the first lighting test circuit and the second lighting test circuit.

3. The display panel of claim 2, wherein the second lighting test circuit overlaps the data integrated circuit.

4. The display panel of claim 2, wherein the data integrated circuit is positioned between the second lighting test circuit and the demultiplexer in the first direction.

5. The display panel of claim 1, further comprising:

a third data line extending in the first direction; and a third pixel group electrically connected to the third data line, wherein the first pixel group includes a first first-color pixel that displays a first color and a first second-color pixel that displays a second color different from the first color, wherein the second pixel group includes a third-color pixel that displays a third color different from each of the first color and the second color, wherein the third pixel group includes a second first-color pixel that displays the first color and a second second-color pixel that displays the second color, wherein the first first-color pixel is aligned with the second second-color pixel in a second direction different from the first direction, and wherein the first second-color pixel is aligned with the second first-color pixel in the second direction.

6. The display panel of claim 5, wherein the first lighting test circuit is configured to provide the first lighting test voltage to the second pixel group, and wherein the second lighting test circuit is configured to provide the second lighting test voltage to the first pixel group and the third pixel group.

7. The display panel of claim 6, wherein the second lighting test circuit is configured to alternately provide the second lighting test voltage to the first first-color pixel and the first second-color pixel.

8. The display panel of claim 6, wherein the first lighting test circuit includes a transistor configured to provide a third lighting test voltage to the third-color pixel in response to a test control signal.

9. The display panel of claim 6, wherein the second lighting test circuit further comprises a second test transistor, wherein the first test transistor is configured to provide a first test voltage to the first first-color pixel in response to a first control signal, and wherein the second test transistor is configured to provide a second test voltage to the first second-color pixel in response to a second control signal.

10. The display panel of claim 5, wherein the first lighting test circuit is configured to provide the first lighting test voltage to the first pixel group and the third pixel group, and wherein the second lighting test circuit is configured to provide the second lighting test voltage to the second pixel group.

11. The display panel of claim 10, wherein the first lighting test circuit is configured to alternately provide the first lighting test voltage to the first first-color pixel and the first second-color pixel.

12. The display panel of claim 10, wherein the first lighting test circuit includes:

a first transistor configured to provide a first test voltage to the first first-color pixel in response to a first control signal; and a second transistor configured to provide a second test voltage to the first second-color pixel in response to a second control signal.

13. The display panel of claim 10, wherein the first test transistor is configured to provide a third lighting test voltage to the third-color pixel in response to a test control signal.

14. A method for manufacturing a display panel, the method comprising:

providing a first data line and a second data line electrically insulated from each other;

providing a first pixel group electrically connected to the first data line;

providing a second pixel group electrically connected to the second data line, wherein no intervening pixel group is positioned between the first pixel group and the second pixel group;

providing a first lighting test circuit configured to provide a first lighting test voltage to at least one of a pixel of the first pixel group and a pixel of the second pixel group through at least one of the first data line and the second data line;

providing a demultiplexer comprising a first control transistor electrically connected to the first data line, comprising a second control transistor electrically connected to the second data line, and configured to provide data signals to the first pixel group and the second pixel group through the first data line and the second data line, respectively, wherein the first lighting test circuit is electrically disconnected from one of the first pixel group and the second pixel group when one of the first control transistor and the second control transistor turns off;

providing a second lighting test circuit comprising a first test transistor and configured to provide a second lighting test voltage to one or more of the pixel of the first pixel group and the pixel of the second pixel group through one or more of the first data line and the second data line, wherein at least one of the first lighting test circuit and the demultiplexer is positioned between the second lighting test circuit and the first pixel group, and wherein the first test transistor is electrically connected through no intervening transistor to each of the first control transistor and the second control transistor;

performing a lighting test process using at least the second lighting test circuit; and after the lighting test process, removing the second lighting test circuit such that the display panel does not include the second lighting test circuit.

15. The display device of claim 14, wherein the plurality of pixel groups includes:

a first pixel group including a first first-color pixel that displays a first color and a first second-color pixel that displays a second color different from the first color;

a second pixel group including a third-color pixel that displays a third color different from each of the first color and the second color; and a third pixel group including a second first-color pixel and a second second-color pixel, wherein the first first-color pixel is aligned with the second second-color pixel in a direction, and wherein the first second-color pixel is aligned with the second first-color pixel in the direction.

16. The display device of claim 15, wherein the first lighting test circuit is configured to provide a first lighting test voltage to the first pixel group and the third pixel group, and wherein the second lighting test circuit is configured to provide a second lighting test voltage to the second pixels group.

17. The display device of claim 15, wherein the first lighting test circuit is configured to provide a first lighting test voltage to the second pixel group, and wherein the second lighting test circuit is configured to provide a second lighting test voltage to the first pixel group and the third pixel group.

18. A display device comprising:

a plurality of pixel groups;

a first lighting test circuit for testing at least one pixel of the plurality of pixel groups;

a demultiplexer for providing data signals to the plurality of pixel groups, wherein the demultiplexer comprises a first control transistor and a second control transistor;

a second lighting test circuit for testing one or more pixels of the plurality of pixel groups, wherein the first lighting test circuit is positioned between the plurality of pixel groups and the demultiplexer, and wherein the second lighting test circuit comprises a first test transistor electrically connected through no intervening transistor to each of the first control transistor and the second control transistor;

a data integrated circuit configured to generate the data signals;

a scan driver configured to generate scan signals for controlling supply of the data signals to the plurality of pixel groups; and a timing controller configured to generate control signals that control the data integrated circuit and the scan driver.

19. The display device of claim 18, wherein the second lighting test circuit overlaps the data integrated circuit.

20. The display device of claim 18, further comprising: a display panel substrate, wherein the second lighting test circuit is positioned between the display panel substrate and the data integrated circuit.

* * * * *